US007921908B2

(12) United States Patent
Tetzlaff et al.

(10) Patent No.: US 7,921,908 B2
(45) Date of Patent: Apr. 12, 2011

(54) GAS RESTRICTOR FOR HORIZONTALLY ORIENTED PUMP

(75) Inventors: Steven K. Tetzlaff, Owasso, OK (US); Lance T. Robinson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 48 days.

(21) Appl. No.: 12/233,309

(22) Filed: Sep. 18, 2008

(65) Prior Publication Data

US 2010/0065280 A1 Mar. 18, 2010

(51) Int. Cl.
*E21B 43/12* (2006.01)
*E21B 34/00* (2006.01)

(52) U.S. Cl. ..... 166/108; 166/50; 166/105.5; 417/295

(58) Field of Classification Search ..... 166/68, 166/105, 105.5, 107, 108, 50, 369; 137/38; 251/349, 354; 417/295
See application file for complete search history.

(56) References Cited

U.S. PATENT DOCUMENTS

| | | | | | |
|---|---|---|---|---|---|
| 1,622,069 | A * | 3/1927 | Thomson et al. | 137/459 |
| 1,934,953 | A * | 11/1933 | Suiter | 137/354 |
| 2,104,008 | A | 1/1938 | Boynton | |
| 2,622,609 | A * | 12/1952 | Moller | 137/38 |
| 3,366,074 | A | 1/1968 | Shirley | |
| 5,107,927 | A * | 4/1992 | Whiteley et al. | 166/50 |
| 5,333,654 | A * | 8/1994 | Faeth | 141/1 |
| 5,333,684 | A | 8/1994 | Walter et al. | |
| 5,588,486 | A * | 12/1996 | Heinrichs | 166/50 |
| 5,794,703 | A * | 8/1998 | Newman et al. | 166/381 |
| 6,026,901 | A | 2/2000 | Brady et al. | |
| 6,089,323 | A * | 7/2000 | Newman et al. | 166/381 |
| 6,138,758 | A | 10/2000 | Shaw et al. | |
| 6,325,152 | B1 | 12/2001 | Kelley et al. | |
| 6,516,888 | B1 * | 2/2003 | Gunnarson et al. | 166/373 |
| 6,554,066 | B2 | 4/2003 | Lopes et al. | |
| 6,715,556 | B2 | 4/2004 | Mack et al. | |
| 7,240,739 | B2 * | 7/2007 | Schoonderbeek et al. | 166/386 |
| 7,270,178 | B2 | 9/2007 | Selph | |
| 7,311,152 | B2 | 12/2007 | Howard et al. | |
| 7,377,327 | B2 * | 5/2008 | Jackson | 166/386 |
| 2002/0096327 | A1 | 7/2002 | Kobylinski et al. | |
| 2003/0079882 | A1 * | 5/2003 | Mack et al. | 166/369 |
| 2004/0060705 | A1 | 4/2004 | Kelley | |
| 2004/0060707 | A1 | 4/2004 | Bearden et al. | |
| 2004/0129428 | A1 | 7/2004 | Kelley | |
| 2006/0231504 | A1 | 10/2006 | Chen et al. | |
| 2009/0159269 | A1 * | 6/2009 | Sheiretov et al. | 166/216 |
| 2009/0301730 | A1 * | 12/2009 | Gweily | 166/369 |
| 2010/0065280 | A1 * | 3/2010 | Tetzlaff et al. | 166/373 |
| 2010/0096140 | A1 * | 4/2010 | Mack | 166/369 |

* cited by examiner

*Primary Examiner* — Jennifer H Gay
(74) *Attorney, Agent, or Firm* — Bracewell & Giulieni LLP

(57) ABSTRACT

A downhole pumping system includes a submersible pump assembly having a pump and a motor, and an inlet apparatus operably coupled to the submersible pump assembly. The inlet apparatus includes a tubular housing for connection to an intake of the pump, the housing having an axis and defining a plurality of circumferentially spaced apart apertures, a plurality of valve members, each valve member positioned within a corresponding aperture, and a plurality of spring members coupled to the housing, each spring member coupled to a corresponding valve member. At least a portion of one or more of the spring members and the valve members extend above the outer surfaces of the housing.

15 Claims, 14 Drawing Sheets

Fig. 8
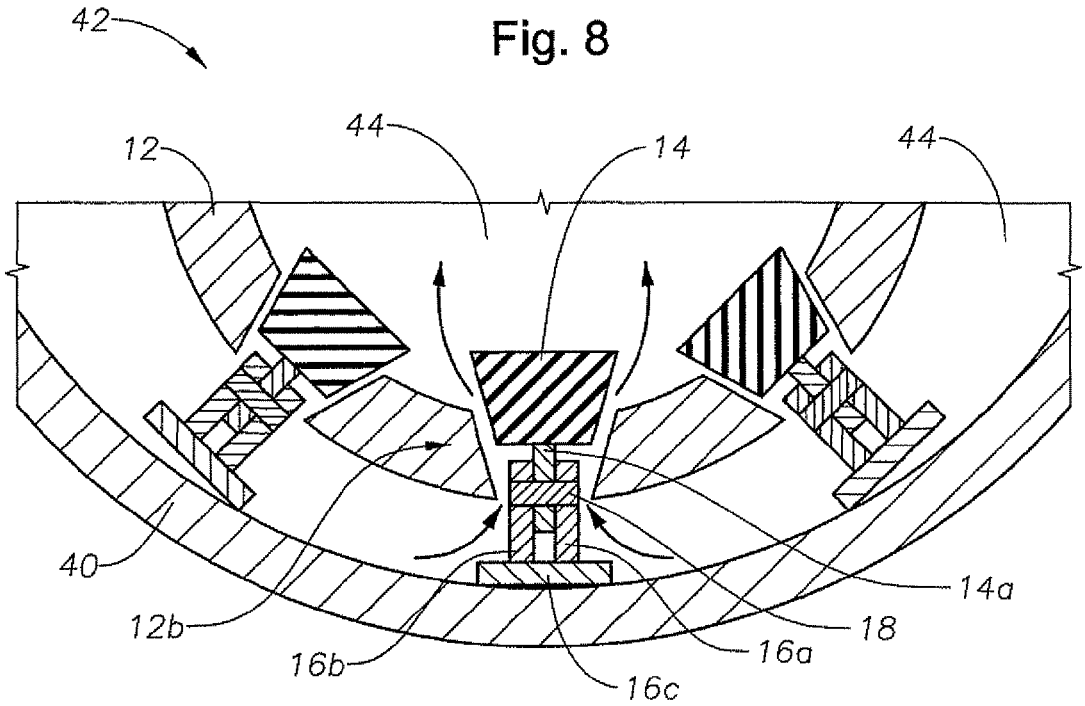
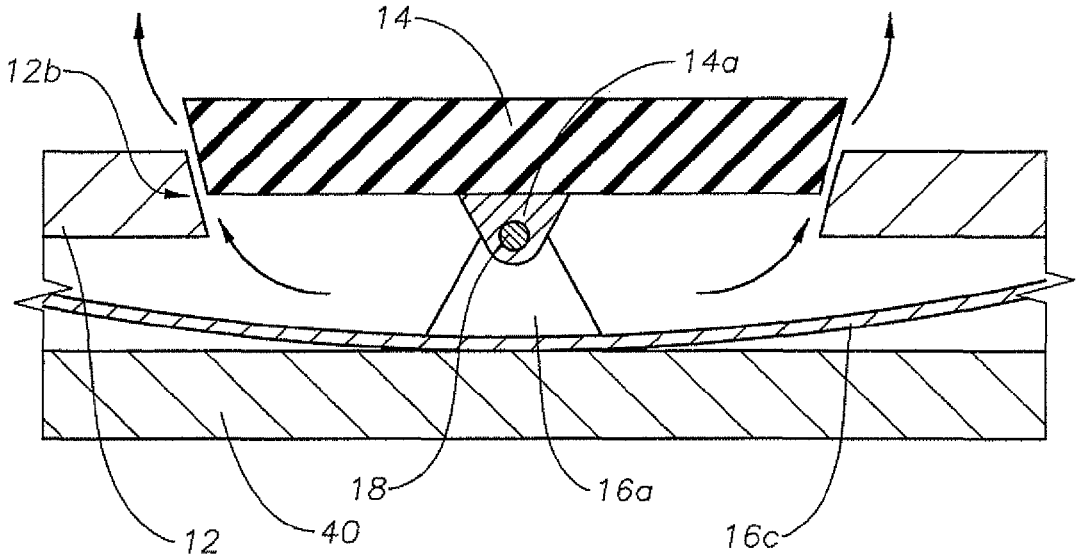
Fig. 10

GAS RESTRICTOR FOR HORIZONTALLY ORIENTED PUMP

BACKGROUND

1. Field of Invention

This invention relates in general to well pumps, and in particular to a restrictor device that restricts entry of gas into the intake of a horizontally oriented well pump.

2. Background of the Invention

Submersible well pumps are frequently employed for pumping well fluid from lower pressure oil wells. One type of pump comprises a centrifugal pump that is driven by a submersible electrical motor. The pump has a large number of stages, each stage comprising a diffuser and an impeller. Another type of pump, called progressive cavity pump, rotates a helical rotor within an elastomeric helical stator. In some installations, the motor for driving a progressive cavity pump is an electrical motor assembly attached to a lower end of the pump. Centrifugal pumps are normally used for pumping higher volumes of well fluid than progressive cavity pumps.

Both types of pumps become less efficient when significant amounts of gas from the well fluid flow into the intakes. In a horizontal well, any gas in the well fluid tends to migrate to the upper side of the casing, forming a pocket of free gas. The gas tends to flow into a portion of the intake on the higher side of the pump intake.

Gas restrictors or separators for coupling to the intake of pump in a horizontal well are known in the prior art. While the prior art types may be workable, improvements are desired, particularly for pumps that pump very viscous crude oil.

SUMMARY OF INVENTION

According to one aspect of the invention, an inlet apparatus for a submersible well pump is provided that includes a tubular housing for connection to an intake of the pump, the housing having an axis and defining a plurality of circumferentially spaced apart apertures; a plurality of valve members, each valve member positioned within a corresponding aperture; and a plurality of spring members coupled to the housing, each spring member coupled to a corresponding valve member; wherein at least a portion of one or more of the spring members and the valve members extend above the outer surfaces of the housing.

According to another aspect of the present invention, a method of operating an intake valve for a submersible pump, the intake valve comprising a housing defining a plurality of circumferentially spaced apart apertures and comprising valve elements for controlling the flow of materials through corresponding circumferentially spaced apart apertures, is provided that includes resiliently biasing the valve elements into engagement with the corresponding apertures; supporting the intake valve on a surface using one or more of the valve elements and the resilient bias; and permitting materials to flow into the intake valve using one or more of the valve elements supporting the intake valve on the surface and the valve elements corresponding to the resilient bias supporting the intake valve on the surface.

According to another aspect of the invention, an apparatus for pumping a well is provided that includes a pump; the pump having an intake section; a tubular housing comprising an end coupled to the intake of the pump, the housing having an axis and defining a plurality of circumferentially spaced apart apertures; a plurality of valve members, each valve member positioned within a corresponding aperture; and a plurality of spring members coupled to the housing, each spring member coupled to a corresponding valve member; wherein at least a portion of one or more of the spring members and the valve members extend above the outer surfaces of the housing.

According to another aspect of the present invention, a method of operating a pump within a wellbore casing using an intake valve comprising a housing defining a plurality of circumferentially spaced apart apertures and comprising valve elements for controlling the flow of materials through corresponding circumferentially spaced apart apertures is provided that includes resiliently biasing the valve elements into engagement with the corresponding apertures; supporting the intake valve and pump on a surface of the wellbore casing using one or more of the valve elements and the resilient bias; and permitting materials to flow into the intake valve using one or more of the valve elements supporting the intake valve and pump on the surface of the wellbore casing and the valve elements corresponding to the resilient bias supporting the intake valve and pump on the surface of the wellbore casing.

BRIEF DESCRIPTION OF DRAWINGS

Some of the features and benefits of the present invention having been stated, others will become apparent as the description proceeds when taken in conjunction with the accompanying drawings, in which:

FIG. 8 is a fragmentary cross sectional view of the intake valve of the assembly of FIG. 6 in a direction transverse to the longitudinal axis of the valve;

FIG. 10 is a fragmentary cross sectional view of the intake valve of the assembly of FIG. 6 in a direction along the longitudinal axis of the valve;

DETAILED DESCRIPTION OF THE EXEMPLARY EMBODIMENTS

Figure 1:
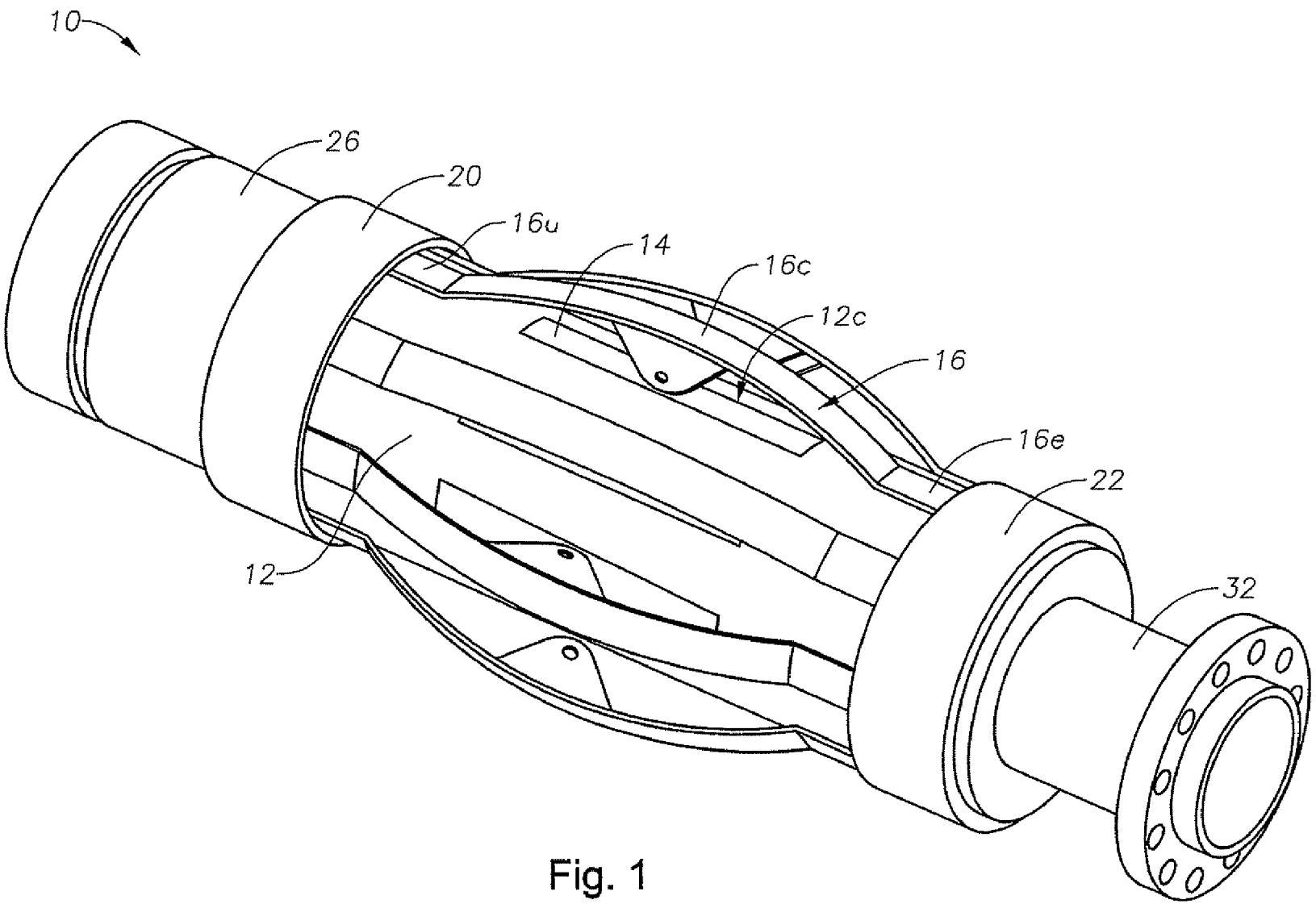
FIG. 1 is a perspective view of an exemplary embodiment of an intake valve for use with a horizontally oriented submersible pump.
Figure 2:
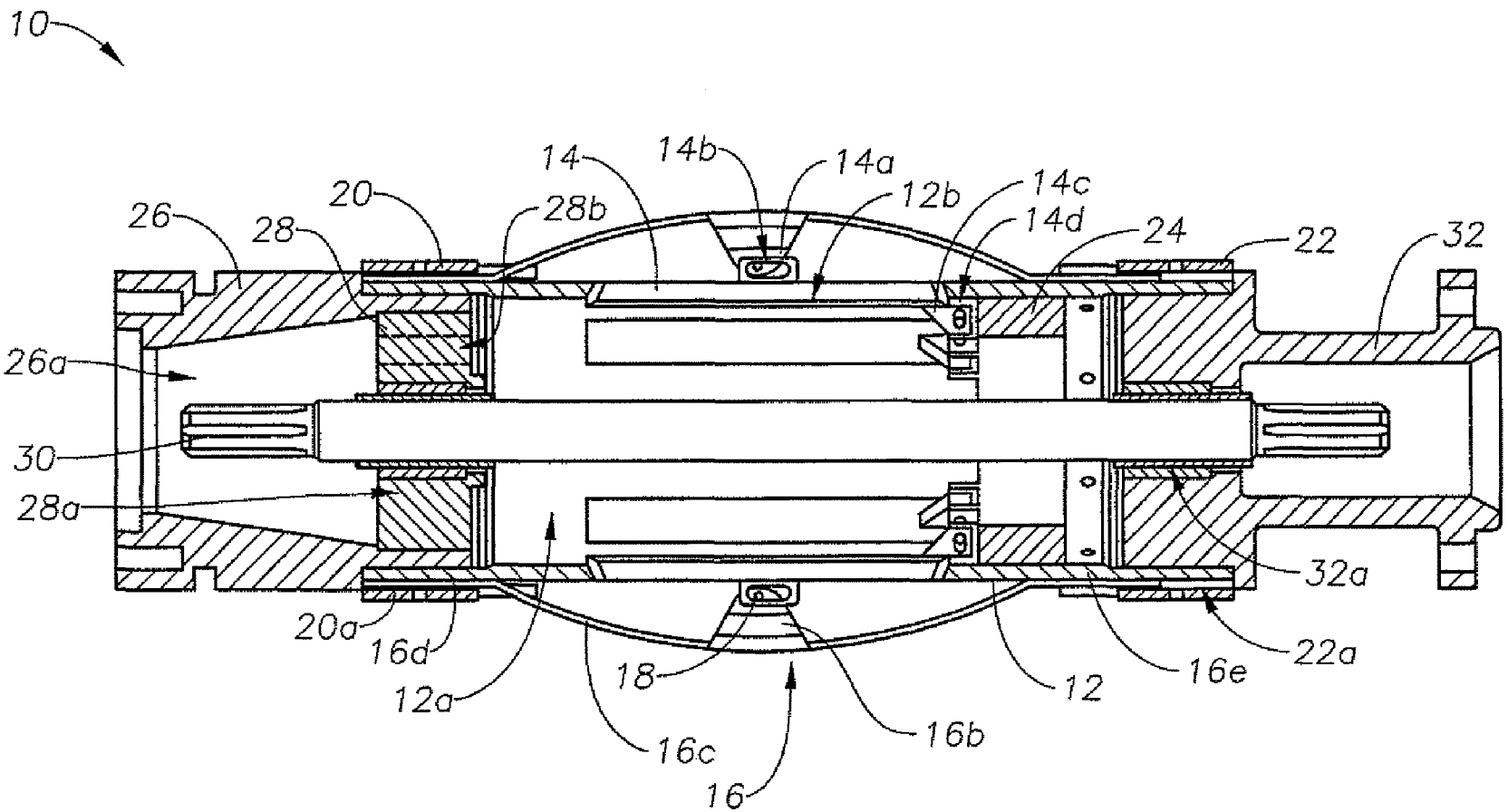
FIG. 2 is a cross sectional view of the intake valve of FIG. 1 in the longitudinal direction.
Figure 2A:
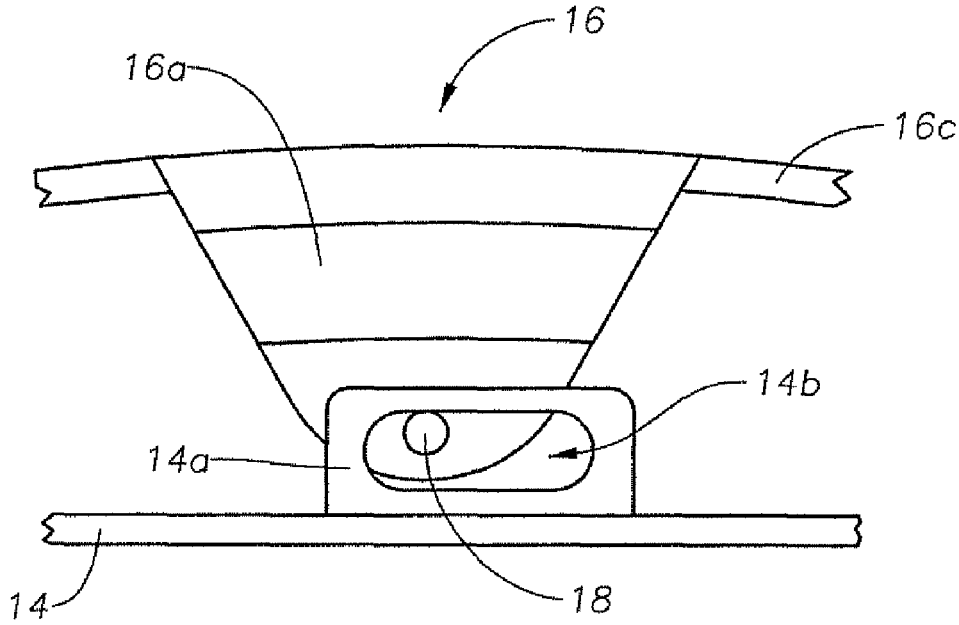
FIG. 2*a* is a fragmentary cross sectional view of the intake valve of FIG. 1 in the longitudinal direction.
Figure 2B:
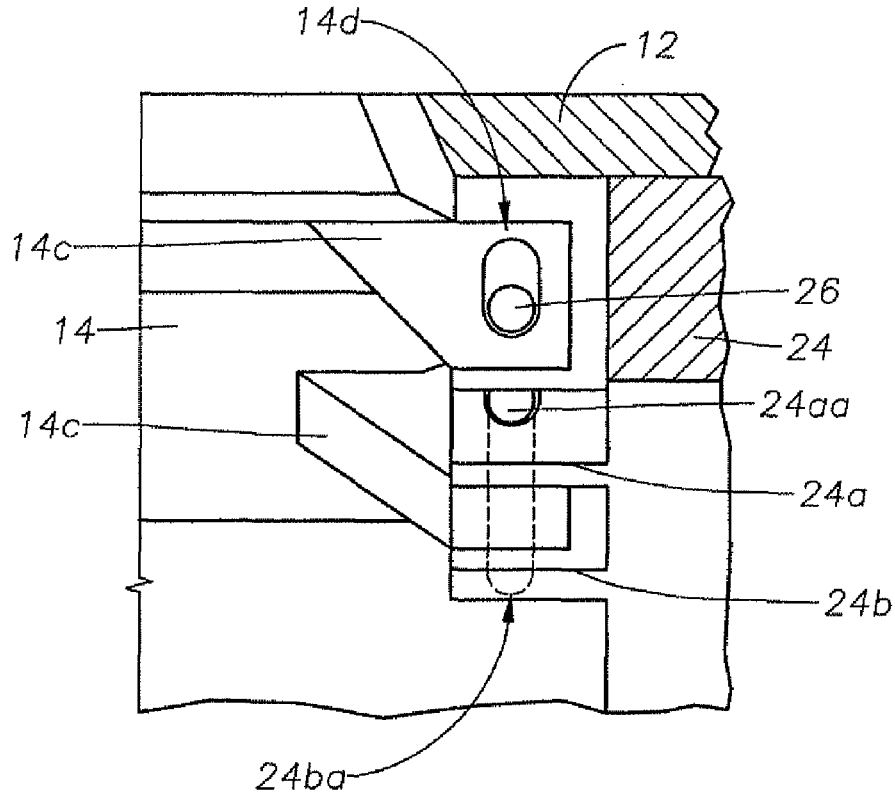
FIG. 2*b* is a fragmentary cross sectional view of the intake valve of FIG. 1 in the longitudinal direction.
Figure 3:
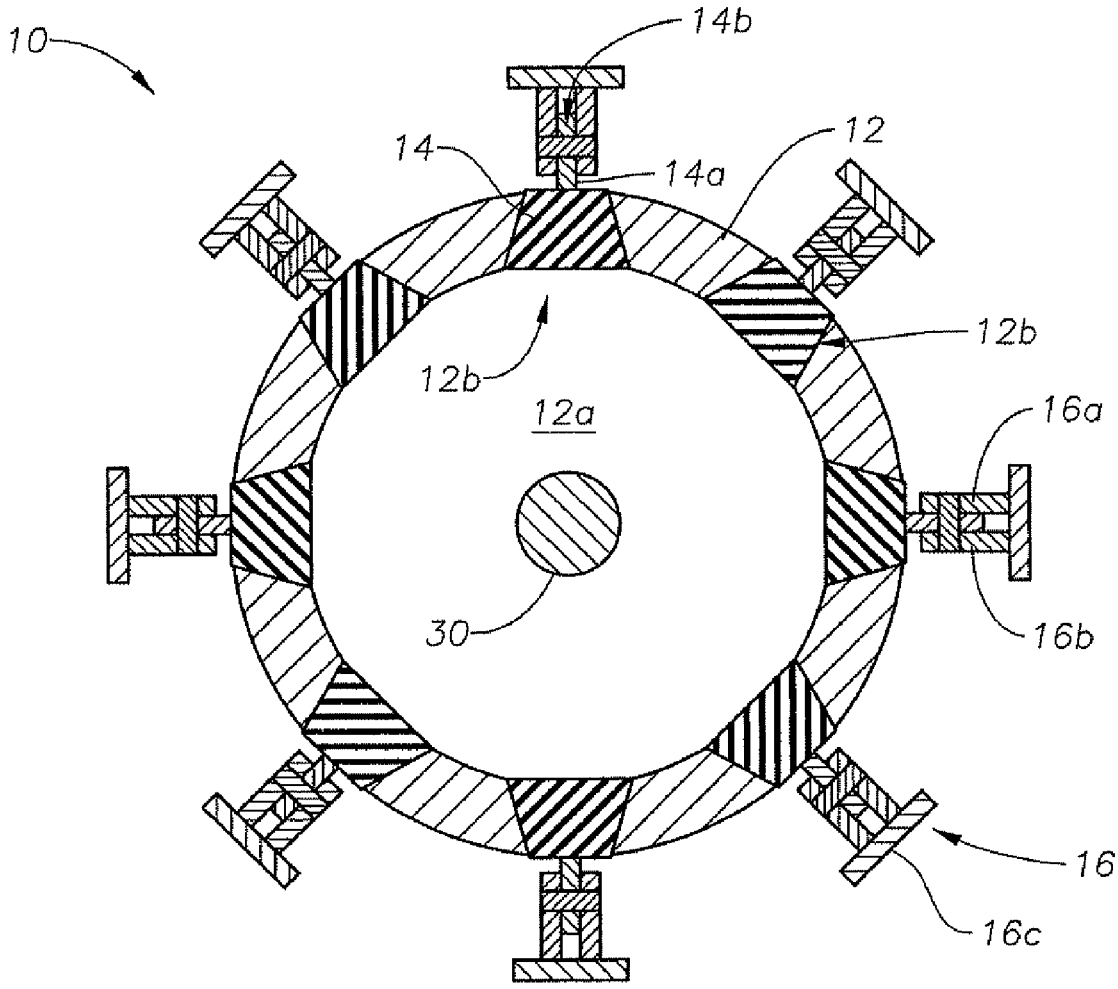
FIG. 3 is a cross sectional view of the intake valve of FIG. 1 in a direction transverse to the longitudinal axis of the valve.
Figure 4:
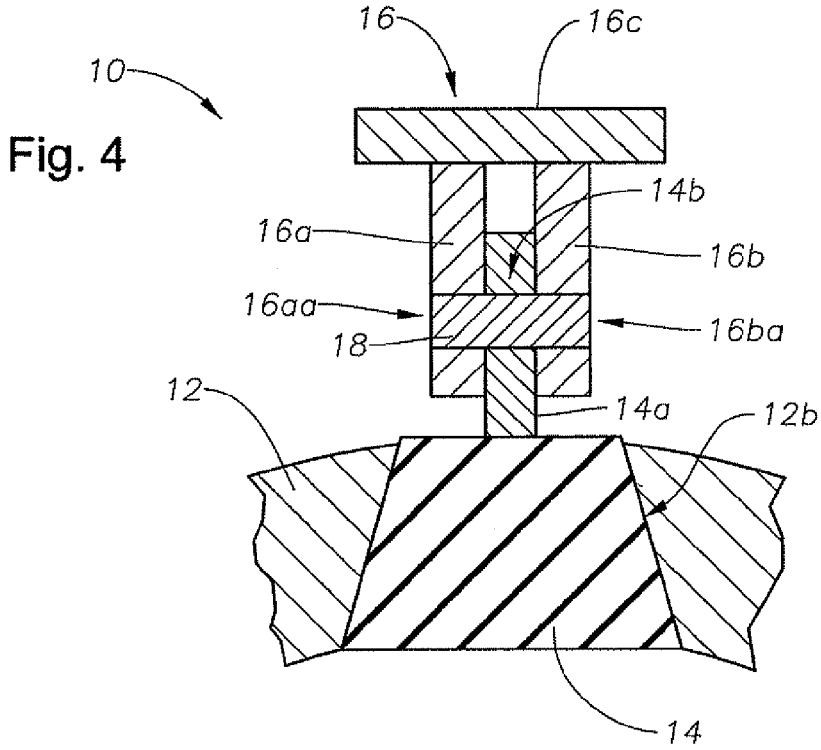
FIG. 4 is a fragmentary cross sectional view of the intake valve of FIG. 1 in a direction transverse to the longitudinal axis of the valve.
Figure 5:
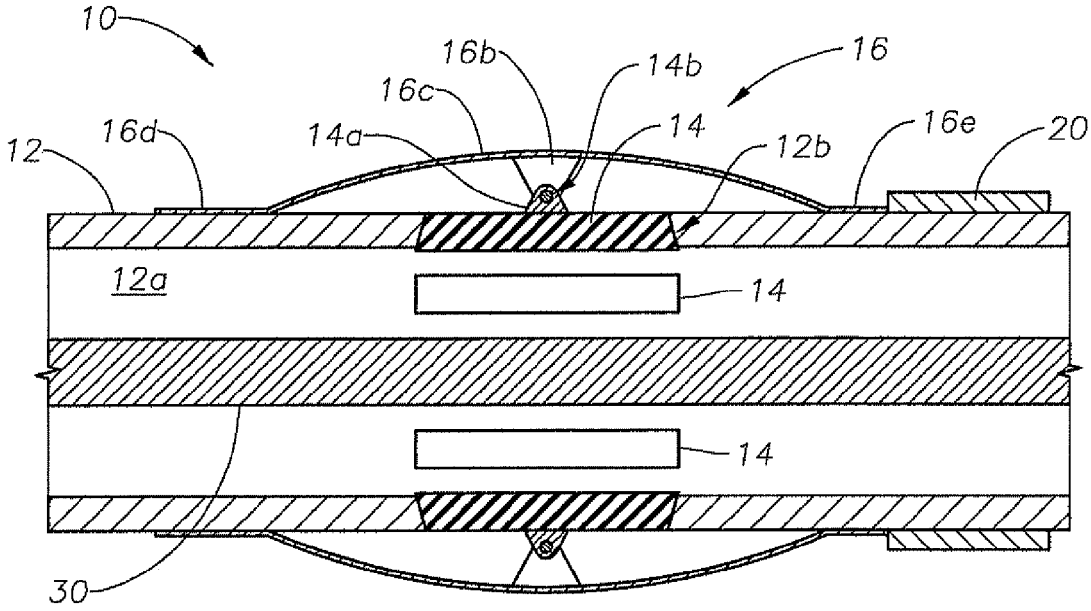
FIG. 5 is a cross sectional view of the intake valve of FIG. 1 in a direction along the longitudinal axis of the valve.

The present invention will now be described more fully hereinafter with reference to the accompanying drawings in which exemplary embodiments of the invention are shown. This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

Referring initially to FIGS. 1, 2, 2*a*, 2*b*, 3, 4 and 5, an exemplary embodiment of an intake valve 10 for use with a horizontally oriented submersible well pump includes a tubular housing 12 that defines a longitudinal through passage 12*a* and a plurality of circumferentially spaced apart radial passages 12*b* that are tapered in a radial direction and extend in a longitudinal direction. A plurality of tapered valve members 14 that each include a support arm 14*a* extending from a center portion of one end that defines a passage 14*b* therethrough and a support arm 14*c* extending from another end that defines a passage 14*d* therethrough are adapted to mate with and be received within corresponding radial passages 12*b* for relative radial movement thereof. In an exemplary embodiment, the passages, 14*b* and 14*d*, of the support arms, 14*a* and 14*c*, may, for example, be circular or elongated in order accommodate relative motion between the support arms and any supporting elements coupled thereto. In an exemplary embodiment, as illustrated in FIGS. 2-5, the valve members 14 have a trapezoidal shape in cross section. In an exemplary embodiment, the tapered profiles of the radial passages 12*b* and valve member 14 prevent removal of the valve members out of the housing 12 through the radial passages. In this manner, the valve members 14 may be displaced radially inward and outward into and out of full engagement with the corresponding radial passage 12*b*. In this manner, the flow of fluidic materials through the radial passages 12*b* may be controlled by the radial displacement of the valve members 14 relative to the corresponding radial passages 12*b*.

The support arms 14*a* of the valve members 14 are received within and between opposing pairs of support arms, 16*a* and 16*b*, that define passages therethrough, 16*aa* and 16*ba*, and extend from an interior side of a curved portion 16*c* of a corresponding spring arm 16. In an exemplary embodiment, each of the spring arms 16 further includes a first straight end portion 16*d* and a second straight end portion 16*c* that extend from opposite ends of the curved portion 16*c*.

In an exemplary embodiment, a pin 18 extends through the passages 14*b*, 16*aa* and 16*ba* of the support arms 14*a*, 16*a* and 16*b*, respectively, in order to pivotally couple the valve elements 14 to the curved portions 16*c* of the corresponding spring arms 16. The first straight end portions 16*d* of the spring arms 16 are received within and mate with a channel 20*a* defined within a first retention collar 20 that is mounted upon the curved outer surface of one end of the housing 12 and the second straight end portions 16*e* of the spring arms are received within and mate within a channel 22*a* defined in a second retention collar 22 that is mounted upon the curved outer surface of another end of the housing.

In an exemplary embodiment, the ends of the straight end portions, 16*d* and 16*e* of the spring arms 16, may be fixed and/or may be rigidly connected to the retention collars, 20 and 22, respectively. In this manner, the spring arms 16 are maintained in a circumferentially spaced apart configuration about the circumference of the housing 12. Thus, if a particular spring arm 16 is acted upon in an inward radial direction by an outside force, the curved portion 16*c* of the particular spring arm will be displaced in an inward radial direction thereby also displacing the corresponding valve element 14 in an inward radial direction.

In an exemplary embodiment, the support arms 14*c* of the valve elements 14 are received within and mate with pairs of circumferentially spaced apart support arms, 24*a* and 24*b*, having passages, 24*aa* and 24*ba*, that extend from a tubular support member 24 that is received within and is coupled to one end of the housing 12. In an exemplary embodiment, pins 26 extend through the passages 14*d* of the support arms 14*c* of the valve elements 14 with the ends of the pins coupled to and received within the passages, 24*aa* and 24*ba*, of the support arms, 24*a* and 24*b*, respectively, of the support member 24. In this manner, as the valve elements 14 are displaced in a radial direction relative to the housing 12, the valve elements are also coupled to the housing 12 and support member 24.

An end of a tubular adaptor 26 that defines a passage 26*a* is coupled to an end of the tubular housing 12. A tubular support 28 is positioned within an end of the passage 26*a* of the adaptor 26 that defines a passage 28*a* and one or more other passages 28*b*. In an exemplary embodiment, the passage 28*a* of the tubular support 28 is adapted to mate with and support an end of a drive shaft 30. In an exemplary embodiment, in order to facilitate the support of the drive shaft 30 during operation, the passage 28*a* of the tubular support 28 further includes a conventional bearing, or other equivalent device, for supporting the end of the drive shaft during rotation of the drive shaft therein. Another end of the drive shaft 30 is received within and support by a passage 32*a* defined in an end of a tubular adapter 32 that is coupled to another end of the tubular housing 12. In an exemplary embodiment, in order to facilitate the support of the drive shaft 30 during operation, the passage 32*a* of the tubular adapter 32 further includes a conventional bearing, or other equivalent device, for supporting the end of the drive shaft during rotation of the drive shaft therein.

Referring now to FIGS. 6-10, in an exemplary embodiment, during operation, one end of the valve 10 may be assembled with and coupled to a conventional submersible pump 34. In particular, and end of the drive shaft 30 of the valve 10 may be coupled to an end of a drive shaft for driving a conventional submersible pump 34 and the end of the tubular adaptor 26 may be coupled to an inlet 34*a* of the submersible pump. The design and operation of the submersible pump 34 as well as the process of connecting the valve 10 with the submersible pump 34 are considered well known to persons having ordinary skill in the art.

In an exemplary embodiment, the other end of the valve 10 may be assembled with and coupled to a conventional seal assembly 36 and motor 38. In particular, the other end of the drive shaft 30 of the valve 10 may be coupled to an end of a drive shaft passing through the seal assembly 36 and coupled to and driven by the motor 38 and the end of the tubular adapter 32 may be coupled to an end of the seal assembly. The design and operation of the seal assembly 36 and motor 38 as well as the process of connecting the valve 10 with the seal assembly 36 are considered well known to persons having ordinary skill in the art.

In this manner, materials may only enter the valve 10 to be pumped by the pump 34 through the radial passages 12*b* of the tubular housing 12 of the valve. In an exemplary embodiment, the outlet 34*b* of the submersible pump 34 may be connected to another conduit in order convey materials exhausted through the outlet of the pump. Furthermore, in this manner, the pump 34 may be driven by the motor 38.

Figure 6:
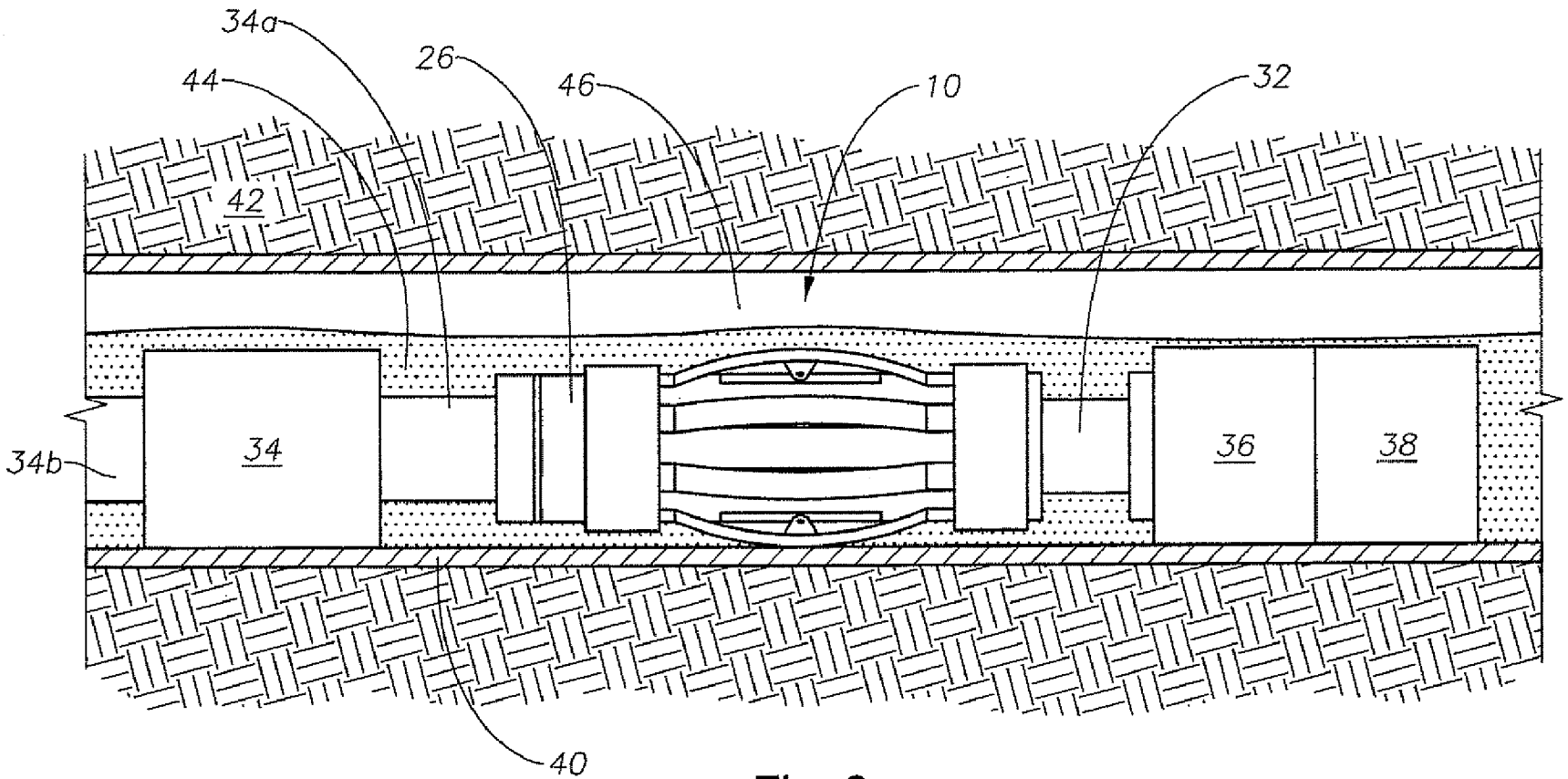
FIG. 6 is a fragmentary cross sectional view of a horizontally oriented well pump assembly that includes the valve of FIG. 1.
Figure 7:
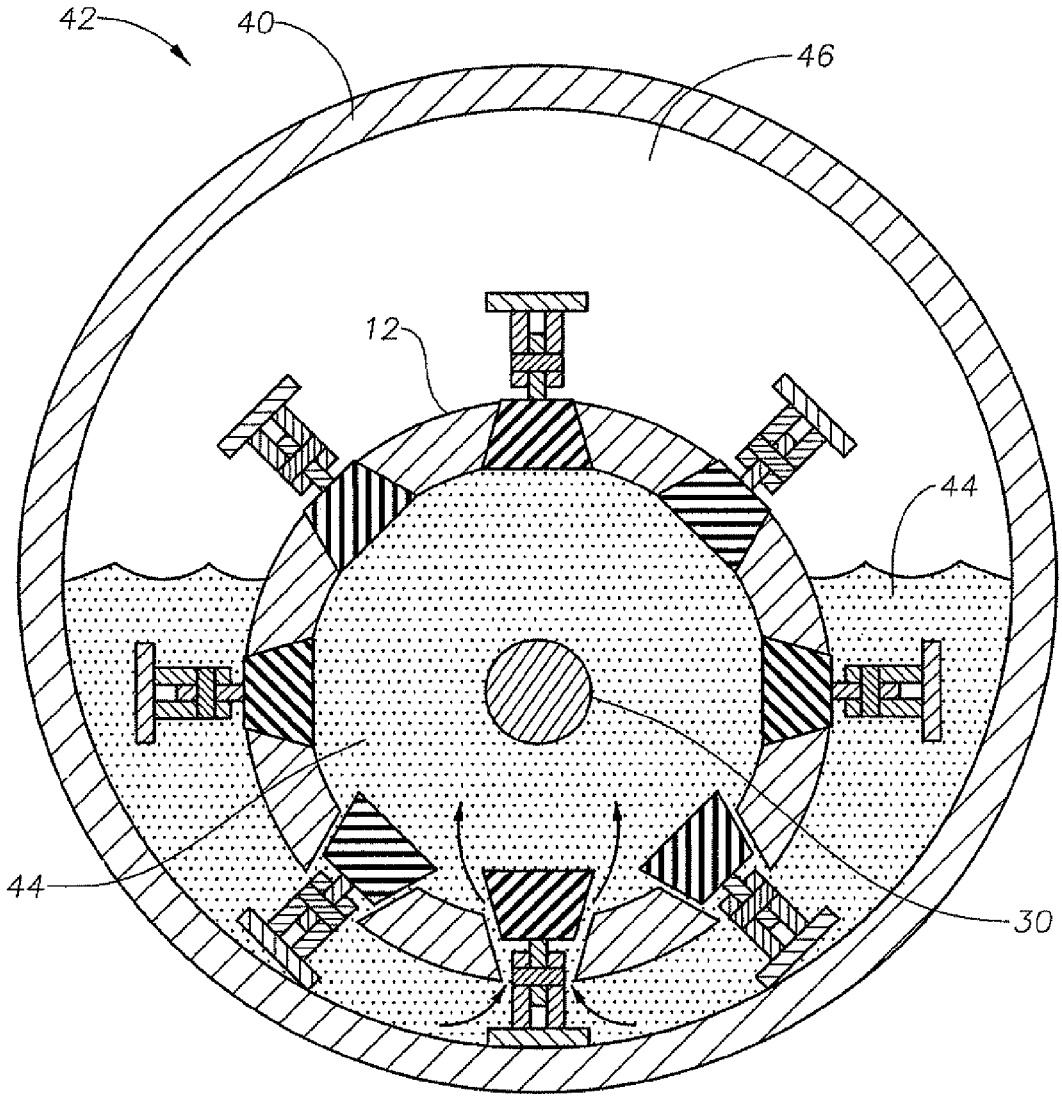
FIG. 7 is a cross sectional view of the intake valve of the assembly of FIG. 6 in a direction transverse to the longitudinal axis of the valve.
Figure 9:
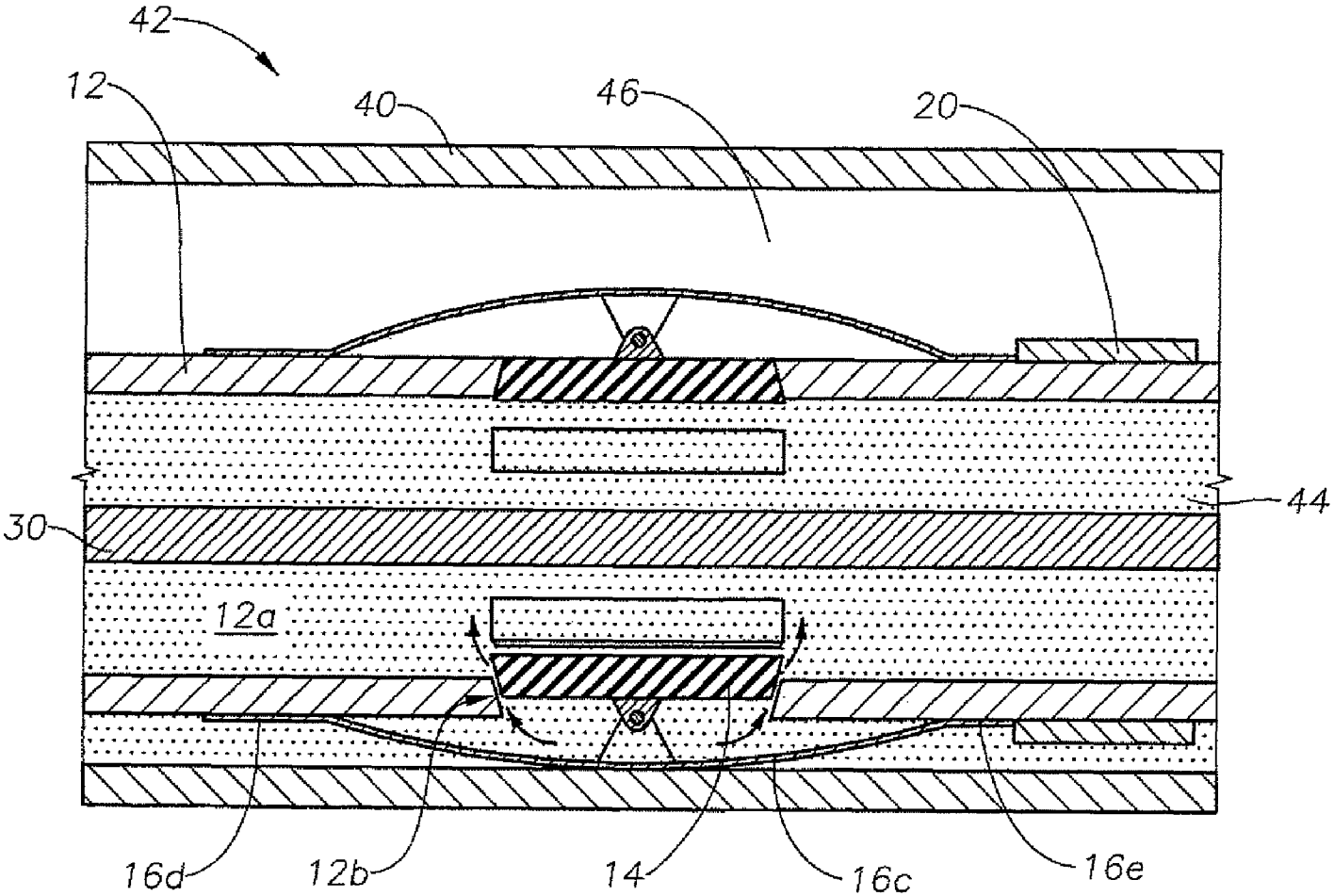
FIG. 9 is a cross sectional view of the intake valve of the assembly of FIG. 6 in a direction along the longitudinal axis of the valve.

In an exemplary embodiment, as illustrated in FIG. 6, the valve 10, pump 34, seal assembly 36 and motor 38 may be positioned within a wellbore casing 40 that traverses a subterranean formation 42. In an exemplary embodiment, the casing 40 may be positioned in a horizontal orientation and may contain fluidic materials 44 and gaseous materials 46. Thus, due to the relative buoyancy of the gaseous materials 46, in an exemplary embodiment, a lower portion of the casing 40 may contain the fluidic materials 44 and an upper portion of the casing may contain the gaseous materials 46.

In an exemplary embodiment, an outside force is directed in an inward radial direction at the curved portions 16*c* of the spring arms 16 of the valve 10 that are positioned within the lower portion of the casing 40 such as, for example, by at least initially supporting the weight of the valve element, pump 34, seal assembly 36 and motor 38 on the curved portions of the spring arms of the valve element that rest upon the inner surface of the lower portion of the casing. As a result, in an exemplary embodiment, pump 34, seal assembly 36 and motor 38 may come to rest on the bottom interior surface of the wellbore casing 40 while several of the curved portions 16*c* of the spring arms 16 are displaced in an inward radial direction.

In this manner, as illustrated in FIGS. 7-10, the valve elements 14 that are connected to the curved portions 16*c* of the spring arms 16 that are displaced in an inward radial direction by the weight of the valve 10, pump 24, seal assembly 36 and motor 38 are displaced in an inward radial direction relative to the tubular housing 12 of the valve. As a result, the fluidic materials 44 within the lower portion of the casing 40 are permitted to flow into the interior 12*a* of the tubular housing 12 of the valve 10 and gaseous materials 46 within the upper portion of the casing are prevented from flowing into the interior of the tubular housing of the valve. As a result, the pump 34 may only be required to pump the fluidic materials 44 within the casing 40 and not any of the gaseous materials 46 within the casing. As a result, the operational efficiency of the pump 34 may be improved.

In an exemplary embodiment, the geometric shapes of the valve elements 14 may or may not be uniform. In an exemplary embodiment, one or more of the valve elements 14 may be square, rectangular, circular, oval, linear, non-linear, faceted, or have other geometric shapes within one or more cross-sectional planes. In an exemplary embodiment, the geometry of the radial passages 12 may include a radius that may or may not be complementary shaped with regard to the corresponding valve element 14.

Figure 11:
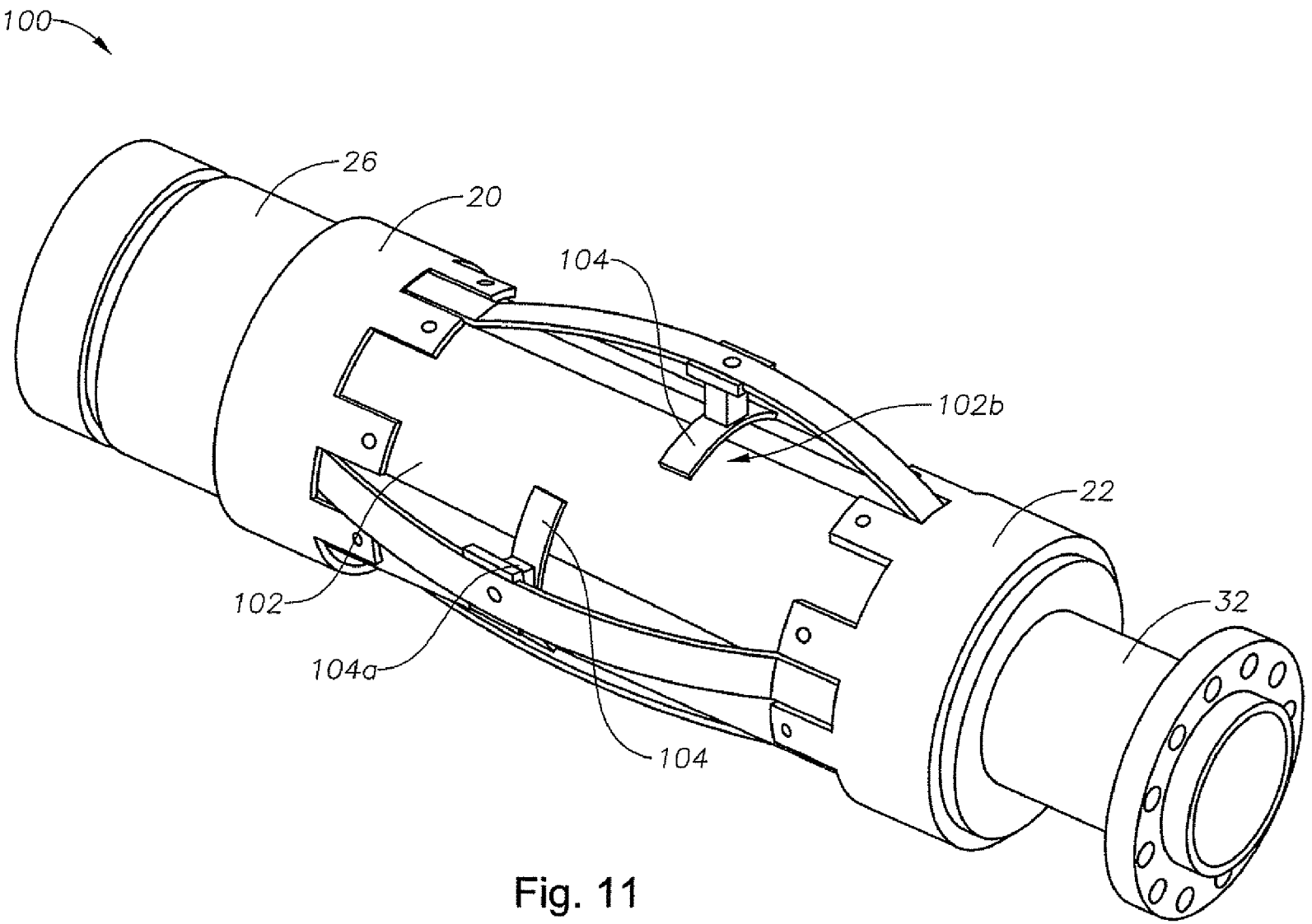
FIG. 11 is a perspective view of an exemplary embodiment of an intake valve for use with a horizontally oriented submersible pump.
Figure 12:
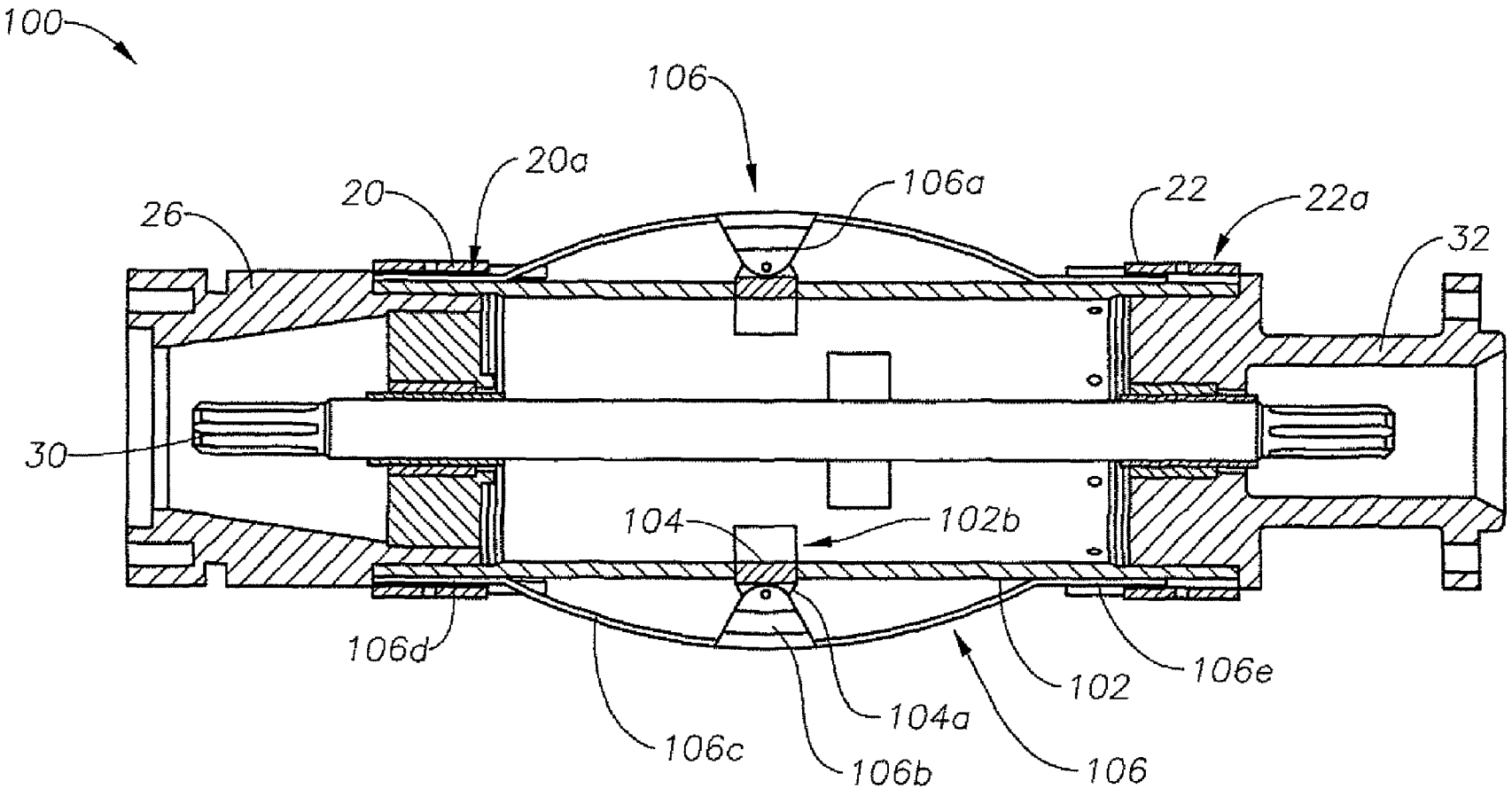
FIG. 12 is a cross sectional view of the intake valve of FIG. 11 in the longitudinal direction.

Referring now to FIGS. 11 and 12, an exemplary embodiment of an intake valve 100 is substantially identical in design and operation to the intake valve 10 except that a housing 102 is substituted for the housing 12 that that defines a longitudinal through passage 102*a* and a plurality of circumferentially spaced apart radial passages 102*b* that are tapered in a radial direction and extend in a circumferential direction. In an exemplary embodiment, the alignment of the radial passages 102*b* is staggered along the length of the housing 102.

A plurality of tapered valve members 104 that each include a support arm 104*a* are adapted to mate with and be received within corresponding radial passages 102*b* for relative radial movement thereto. In an exemplary embodiment, the valve members 104 have a trapezoidal shape in cross section. In an exemplary embodiment, the tapered profiles of the radial passages 102*b* and valve member 104 prevent removal of the valve members out of the housing 102 through the radial passages. In this manner, the valve members 104 may be displaced radially inward and outward into and out of full engagement with the corresponding radial passage 102*b*. In this manner, the flow of fluidic materials through the radial passages 102*b* may be controlled by the radial displacement of the valve members 14 relative to the corresponding radial passages 102*b*.

The support arms 104*a* of the valve members 104 are received within and between, and pivotally coupled to, opposing pairs of support arms, 106*a* and 106*b*, that extend from an interior side of a curved portion 106*c* of a corresponding spring arm 106. In an exemplary embodiment, each of the spring arms 106 further includes a first straight end portion 106*d* and a second straight end portion 106*e* that extend from opposite ends of the curved portion 106*c*.

The first straight end portions 106*d* of the spring arms 16 are received within and mate with the channel 20*a* defined within the first retention collar 20 that is mounted upon the curved outer surface of one end of the housing 102 and the second straight end portions 106*e* of the spring arms are received within and mate within the channel 22*a* defined in a second retention collar 22 that is mounted upon the curved outer surface of another end of the housing.

In an exemplary embodiment, the ends of the straight end portions, 106*d* and 106*e* of the spring arms 106, may be fixed and/or may be rigidly connected to the retention collars, 20 and 22, respectively. In this manner, the spring arms 106 are maintained in a circumferentially spaced apart configuration about the circumference of the housing 102. Thus, if a particular spring arm 106 is acted upon in an inward radial direction by an outside force, the curved portion 106*c* of the particular spring arm will be displaced in an inward radial direction thereby also displacing the corresponding valve element 104 in an inward radial direction.

In an exemplary embodiment, during operation of the intake valve 100, the intake valve may be substituted for the intake valve 10 in the assembly illustrated and described above with reference to FIG. 6.

Figure 13:
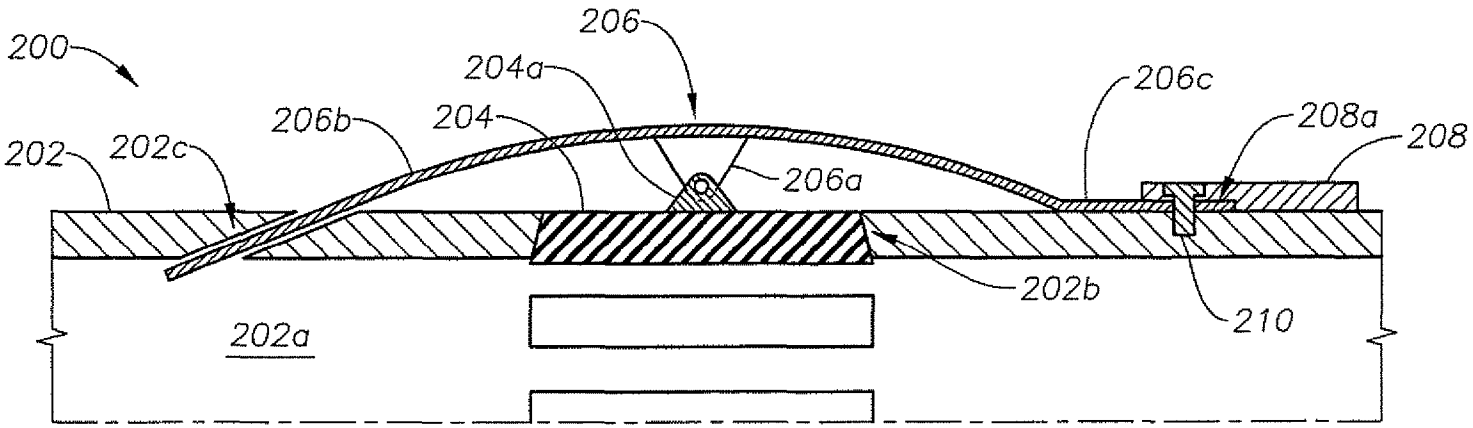
FIG. 13 is a fragmentary cross sectional view of an exemplary embodiment of an intake valve for use with a horizontally oriented submersible pump.

Referring now to FIG. 13, an exemplary embodiment of an intake valve 200 is substantially identical in design and operation to the intake valve 10 except that a housing 202 is substituted for the housing 12 that defines a longitudinal passage 202*a*, a plurality of circumferentially spaced apart radial passages 202*b* that are tapered in a radial direction and extend in a longitudinal direction, and a plurality of circumferentially spaced apart radial passages 202*c* at one end of the housing that extend in a direction approximately 45 degrees relative to the longitudinal axis of the housing.

A plurality of tapered valve members 204 that each include a support arm 204*a* are adapted to mate with and be received within corresponding radial passages 202*b* for relative radial movement thereto. In an exemplary embodiment, the valve members 204 have a trapezoidal shape in cross section. In an exemplary embodiment, the tapered profiles of the radial passages 202*b* and valve member 204 prevent removal of the valve members out of the housing 202 through the radial passages. In this manner, the valve members 204 may be displaced radially inward and outward into and out of full engagement with the corresponding radial passage 202*b*. In this manner, the flow of fluidic materials through the radial passages 202*b* may be controlled by the radial displacement of the valve members 204 relative to the corresponding radial passages 202*b*.

The support arms 204*a* of the valve members 204 are received within and between, and are pivotally coupled to support arms 206*a* that extend from an interior side of a curved portion 206*b* of a corresponding spring arm 206. In an exemplary embodiment, each of the spring arms 206 farther includes a straight end portion 206*c*.

The ends of the curved portions 206*b* of the spring arms 206 are received within and mate with corresponding radial passages 202*c* in the housing 202 and the straight end portions 206*c* of the spring arms are received within and mate with a channel 208*a* defined within a retention collar 208 that is mounted upon the curved outer surface of one end of the housing 202. In an exemplary embodiment, a pin 210, or other equivalent device, is then used to rigidly connect the straight end portions 206*c* of the spring arms within the channel 208*a* of the retention collar 208. In this manner, the straight end portions 206*c* of the spring arms 206 are fixed to the housing 202 while the ends of the curved portions 206*b* of the spring arms may float within the radial passages 202*c* of the housing.

In this manner, the spring arms 206 are maintained in a circumferentially spaced apart configuration about the circumference of the housing 202. Thus, if a particular spring arm 206 is acted upon in an inward radial direction by an outside force, the curved portion 206*b* of the particular spring arm will be displaced in an inward radial direction thereby also displacing the corresponding valve element 204 in an inward radial direction.

In an exemplary embodiment, during operation of the intake valve 200, the intake valve may be substituted for the intake valve 10 in the assembly illustrated and described above with reference to FIG. 6.

Figure 14:
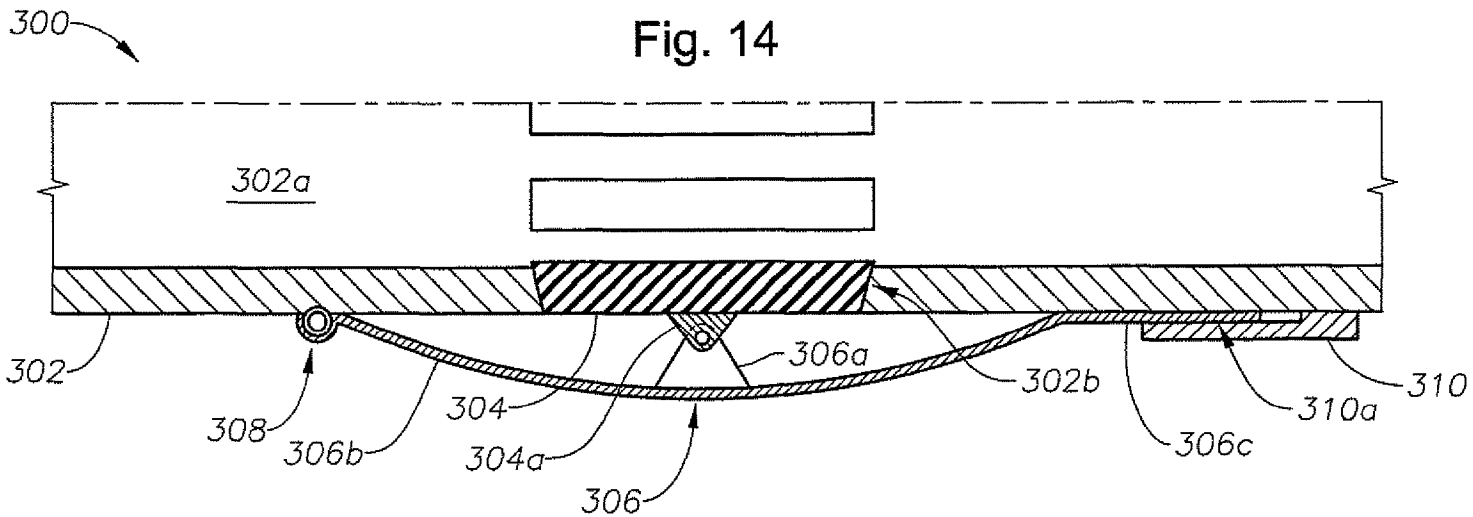
FIG. 14 is a fragmentary cross sectional view of an exemplary embodiment of an intake valve for use with a horizontally oriented submersible pump.

Referring now to FIG. 14, an exemplary embodiment of an intake valve 300 is substantially identical in design and operation to the intake valve 10 except that a housing 302 is substituted for the housing 12 that defines a longitudinal passage 302*a* and a plurality of circumferentially spaced apart radial passages 302*b* that are tapered in a radial direction and extend in a longitudinal direction.

A plurality of tapered valve members 304 that each include a support arm 304*a* are adapted to mate with and be received within corresponding radial passages 302*b* for relative radial movement thereto. In an exemplary embodiment, the valve members 304 have a trapezoidal shape in cross section. In an exemplary embodiment, the tapered profiles of the radial passages 302*b* and valve member 304 prevent removal of the valve members out of the housing 302 through the radial passages. In this manner, the valve members 304 may be displaced radially inward and outward into and out of full engagement with the corresponding radial passage 302*b*. In this manner, the flow of fluidic materials through the radial passages 302*b* may be controlled by the radial displacement of the valve members 204 relative to the corresponding radial passages 302*b*.

The support arms 304*a* of the valve members 304 are received within and between, and are pivotally coupled to support arms 306*a* that extend from an interior side of a curved portion 306*b* of a corresponding spring arm 306. In an exemplary embodiment, each of the spring arms 306 further includes a straight end portion 306*c*.

The ends of the curved portions 306*b* of the spring arms 306 are pivotally coupled to the exterior surface of the 302 by corresponding hinged connections 308 and the straight end portions 306*c* of the spring arms are received within and mate with a channel 310*a* defined within a retention collar 310 that is mounted upon the curved outer surface of one end of the housing 302. In this manner, the straight end portions 306*c* of the spring arms 306 may float within the channel 310*a* of the retention collar 310 while the ends of the curved portions 306*b* are fixed to the housing 302.

In this manner, the spring arms 306 are maintained in a circumferentially spaced apart configuration about the circumference of the housing 302. Thus, if a particular spring arm 306 is acted upon in an inward radial direction by an outside force, the curved portion 306*b* of the particular spring arm will be displaced in an inward radial direction thereby also displacing the corresponding valve element 304 in an inward radial direction.

In an exemplary embodiment, during operation of the intake valve 300, the intake valve may be substituted for the intake valve 10 in the assembly illustrated and described above with reference to FIG. 6.

Figure 15:
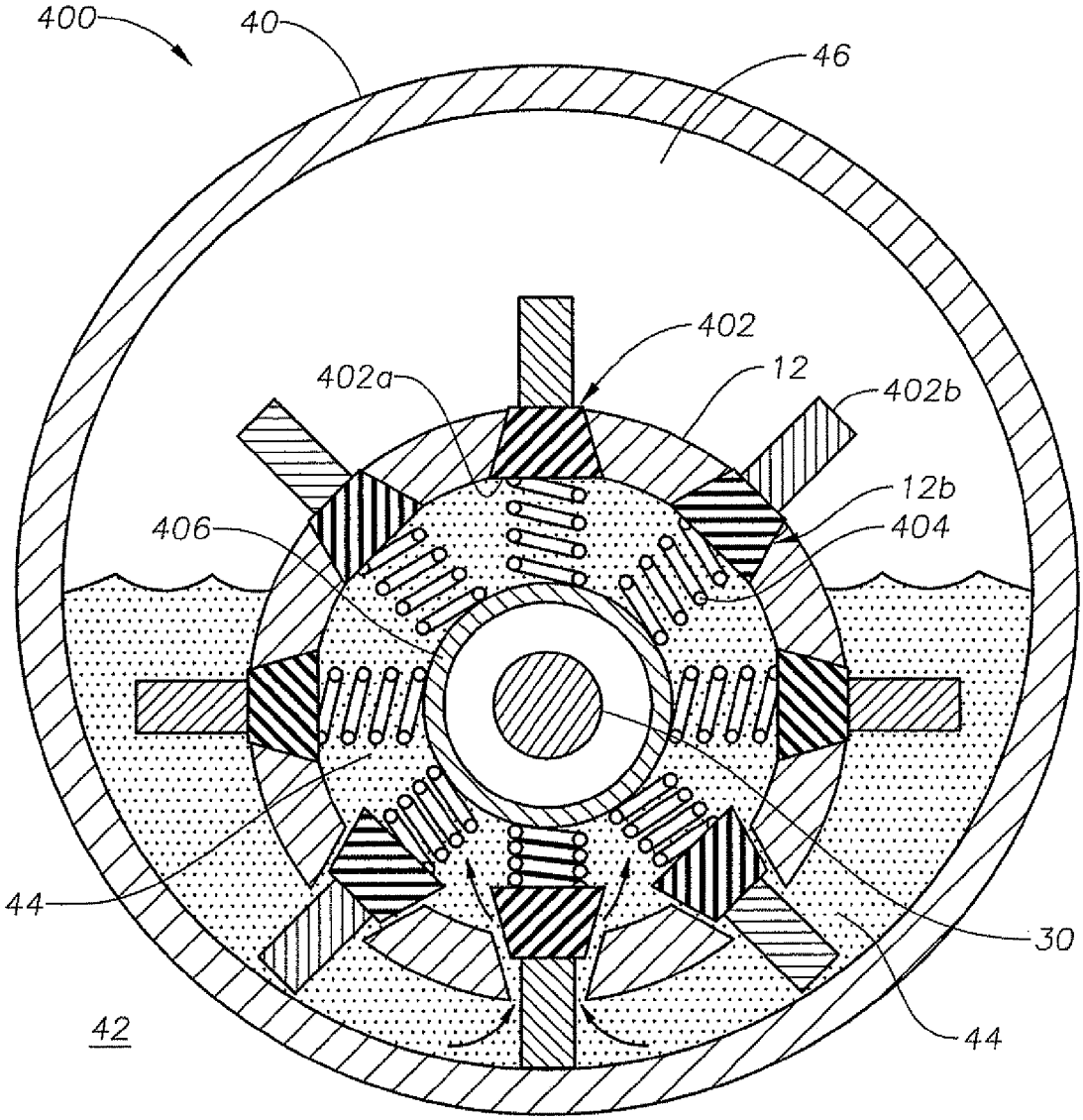
FIG. 15 is a fragmentary cross sectional view of an exemplary embodiment of an intake valve for use with a horizontally oriented submersible pump.

Referring now to FIG. 15, an exemplary embodiment of an intake valve 400 is substantially identical in design and operation to the intake valve 10 except that valve elements 402 are substituted for each of the valve elements 14 that each include a tapered valve members 402*a* adapted to mate with and be received within corresponding radial passages 12*b* of the housing 12 for relative radial movement thereto and sealing engagement therewith and a valve member protrusion 402*b* adapted to extend through the corresponding radial passage and above the exterior surface of the housing. In an exemplary embodiment, the valve members 402*a* have a trapezoidal shape in cross section. In an exemplary embodiment, the tapered profiles of the radial passages 12*b* and valve member 402*a* prevent removal of the valve members out of the housing 12 through the radial passages. In this manner, the valve members 402*a* may be displaced radially inward and outward into and out of full engagement with the corresponding radial passage 12*b* of the housing 12. In this manner, the flow of fluidic materials through the radial passages 12*b* may be controlled by the radial displacement of the valve members 402*a* relative to the corresponding radial passages 12*b*.

Ends of springs 404 contact and are coupled to the inner radial ends of corresponding valve members 402 and the other ends of the springs 404 contact and are coupled to a tubular support member 406 positioned within and coupled to the housing 12 that also receives the drive shaft 30. In an exemplary embodiment, the springs 404 may be coil springs.

In this manner, the springs 404 are maintained in a circumferentially spaced apart configuration within the circumference of the housing 12. Thus, if a particular valve member protrusion 402*b* of a valve element 402 is acted upon in an inward radial direction by an outside force, the corresponding spring 404 will be compressed and displaced in an inward radial direction thereby also displacing the corresponding valve member 402*a* in an inward radial direction.

In an exemplary embodiment, during operation of the intake valve 400, the intake valve may be substituted for the intake valve 10 in the assembly illustrated and described above with reference to FIG. 6.

Figure 16:
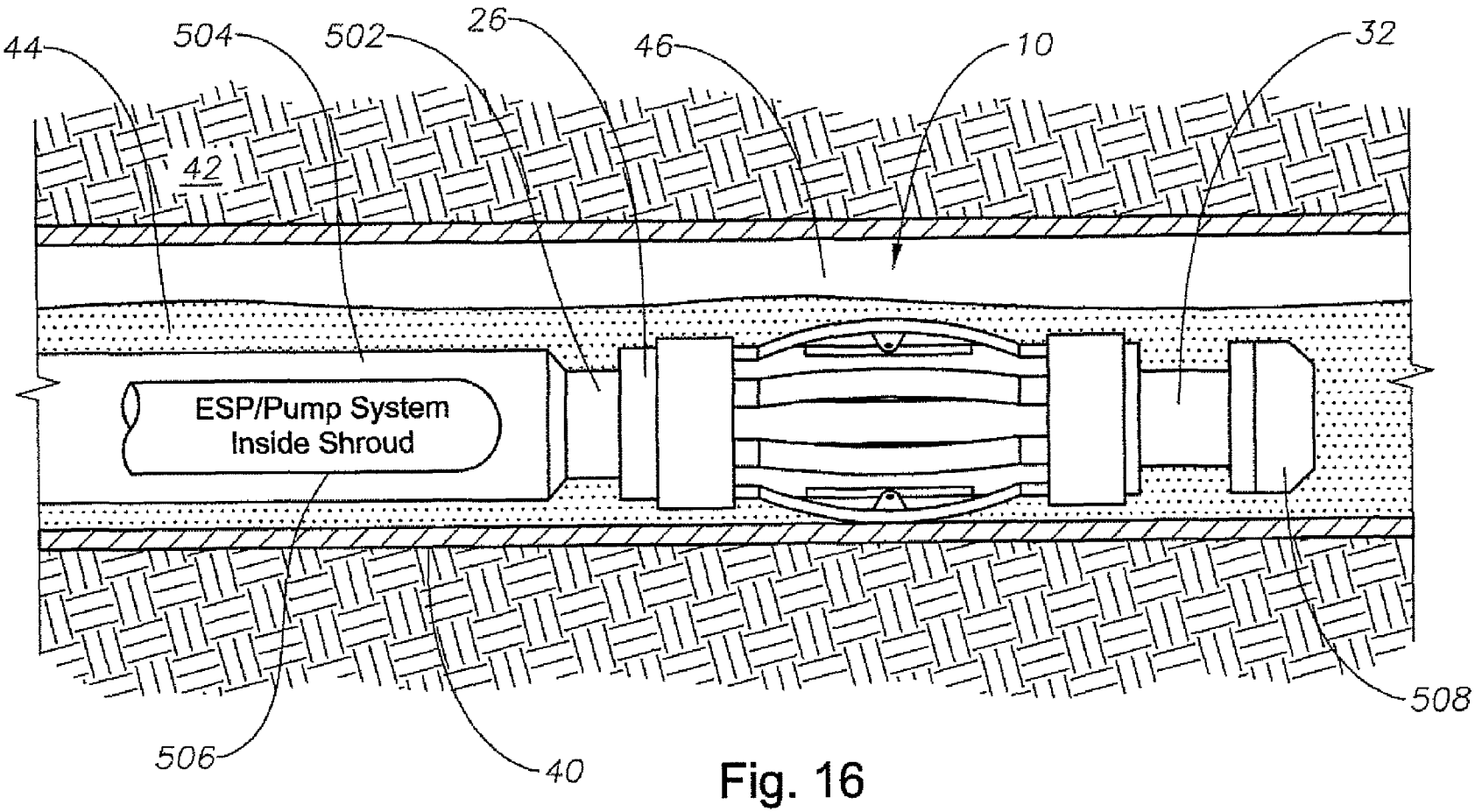
FIG. 16 is a fragmentary cross sectional view of a horizontally oriented well pump assembly that includes the valve of FIG. 1.

Referring now to FIG. 16, in an exemplary embodiment, during operation, the end of the tubular adaptor 26 of the intake valve 10 may be assembled with and coupled to an end of a tubular inlet connection 502 having another end that is coupled to an end of a conventional motor shroud 504 that houses a conventional submersible pumping system 506. In this manner the intake valve 10 may be fluidicly coupled to the inlet of the pumping system 506 housed within the shroud 504. The other end of the intake valve 10 may be fluidicly sealed by coupling a cover cap 508 onto the end of the tubular adapter 32 of the intake valve.

In an exemplary embodiment, the valve 10, shroud 504 and pumping system 506 may be positioned within the wellbore casing 40. In an exemplary embodiment, an outside force is directed in an inward radial direction at the curved portions 16*c* of the spring arms 16 of the valve 10 that are positioned within the lower portion of the casing 40 such as, for example, by at least initially supporting the weight of the valve element, the shroud 504 and the pumping system 506 on the curved portions of the spring arms of the valve element that rest upon the inner surface of the lower portion of the casing. As a result, in an exemplary embodiment, the shroud 504 may come to rest on the bottom interior surface of the wellbore casing 40 while several of the curved portions 16*c* of the spring arms 16 are displaced in an inward radial direction.

During operation, the fluidic materials 44 within the lower portion of the casing 40 are permitted to flow into the interior 12*a* of the tubular housing 12 of the valve 10 and gaseous materials 46 within the upper portion of the casing are prevented from flowing into the interior of the tubular housing of the valve. As a result, the pumping system 506 may only be required to pump the fluidic materials 44 within the casing 40 and not any of the gaseous materials 46 within the casing. As a result, the operational efficiency of the pumping system 506 may be improved.

It is understood that variations may be made in the above without departing from the scope of the invention. For example, the teachings of the exemplary embodiments may be combined, in whole or in part, with any or all of the exemplary embodiments. Furthermore, the teachings of the exemplary embodiments may be used to provide an intake valve for other types of pumps. While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

The invention claimed is:

1. A downhole pumping system, comprising:

a submersible pump assembly comprising a pump and a motor; and an inlet apparatus operably coupled to the submersible pump assembly, the inlet apparatus comprising:

a tubular housing for connection to an intake of the pump, the housing having an axis and defining a plurality of circumferentially spaced apart apertures;

a plurality of valve members, each valve member positioned within a corresponding aperture; and a plurality of spring members coupled to the housing, each spring member coupled to a corresponding valve member;

wherein at least a portion of one or more of the spring members and the valve members extend above the outer surfaces of the housing.

2. The apparatus of claim 1, wherein one or more of the apertures are elongated in a direction parallel to the axis.

3. The apparatus of claim 1, wherein one or more of the apertures are elongated in a direction perpendicular to the axis.

4. The apparatus of claim 1, wherein one or more of the apertures are staggered in a direction parallel to the axis.

5. The apparatus of claim 1, wherein one or more of the apertures are tapered in a radial direction.

6. The apparatus of claim 1, wherein one or more of the apertures comprise one or more edge surfaces comprising a radius for engaging the corresponding valve member.

7. The apparatus of claim 1, wherein first ends of the spring members are connected to the housing.

8. The apparatus of claim 1, wherein second ends of the spring members are not connected to the housing.

9. The apparatus of claim 8, wherein the housing defines a plurality of radial passages; and wherein the second ends of the spring members are received within corresponding radial passages.

10. A downhole pumping system, comprising:

a submersible pump assembly comprising a pump and a motor; and an inlet apparatus operably coupled to the submersible pump assembly, the inlet apparatus comprising:

a tubular housing for connection to an intake of the pump, the housing having an axis and defining a plurality of circumferentially spaced apart apertures;

a plurality of valve members, each valve member positioned within a corresponding aperture; and a plurality of spring members coupled to the housing, each spring member coupled to a corresponding valve member;

wherein at least a portion of one or more of the spring members and the valve members extend above the outer surfaces of the housing; and wherein one or more of the valve members are pivotally coupled to the spring members.

11. A downhole pumping system, comprising:

a submersible pump assembly comprising a pump and a motor; and an inlet apparatus operably coupled to the submersible pump assembly, the inlet apparatus comprising:

a tubular housing for connection to an intake of the pump, the housing having an axis and defining a plurality of circumferentially spaced apart apertures;

a plurality of valve members, each valve member positioned within a corresponding aperture; and a plurality of spring members coupled to the housing, each spring member coupled to a corresponding valve member;

wherein at least a portion of one or more of the spring members and the valve members extend above the outer surfaces of the housing; and wherein one or more of the valve members are pivotally coupled to the housing.

12. A downhole pumping system, comprising:

a submersible pump assembly comprising a pump and a motor; and an inlet apparatus operably coupled to the submersible pump assembly, the inlet apparatus comprising:

a tubular housing for connection to an intake of the pump, the housing having an axis and defining a plurality of circumferentially spaced apart apertures;

a plurality of valve members, each valve member positioned within a corresponding aperture; and a plurality of spring members coupled to the housing, each spring member coupled to a corresponding valve member;

wherein at least a portion of one or more of the spring members and the valve members extend above the outer surfaces of the housing;

wherein the first ends of the spring members are pivotally coupled to the housing.

13. A downhole pumping system, comprising:

a submersible pump assembly comprising a pump and a motor; and an inlet apparatus operably coupled to the submersible pump assembly, the inlet apparatus comprising:

a tubular housing for connection to an intake of the pump, the housing having an axis and defining a plurality of circumferentially spaced apart apertures;

a plurality of valve members, each valve member positioned within a corresponding aperture; and a plurality of spring members coupled to the housing, each spring member coupled to a corresponding valve member;

wherein at least a portion of one or more of the spring members and the valve members extend above the outer surfaces of the housing; and wherein the spring members comprise a curved portion that is coupled to corresponding valve members.

14. A downhole pumping system, comprising:

a submersible pump assembly comprising a pump and a motor; and an inlet apparatus operably coupled to the submersible pump assembly, the inlet apparatus comprising:

a tubular housing for connection to an intake of the pump, the housing having an axis and defining a plurality of circumferentially spaced apart apertures;

a plurality of valve members, each valve member positioned within a corresponding aperture; and a plurality of spring members coupled to the housing, each spring member coupled to a corresponding valve member;

wherein at least a portion of one or more of the spring members and the valve members extend above the outer surfaces of the housing;

wherein the spring members comprise a curved portion that is coupled to corresponding valve members; and wherein the spring members further comprise a first straight portion coupled to an end of the curved portion that extends in a direction parallel to the axis that is coupled to the housing.

15. A downhole pumping system, comprising:

a submersible pump assembly comprising a pump and a motor; and an inlet apparatus operably coupled to the submersible pump assembly, the inlet apparatus comprising:

a tubular housing for connection to an intake of the pump, the housing having an axis and defining a plurality of circumferentially spaced apart apertures;

a plurality of valve members, each valve member positioned within a corresponding aperture; and a plurality of spring members coupled to the housing, each spring member coupled to a corresponding valve member;

wherein at least a portion of one or more of the spring members and the valve members extend above the outer surfaces of the housing;

wherein the spring members comprise a curved portion that is coupled to corresponding valve members;

wherein the spring members further comprise a first straight portion coupled to an end of the curved portion that extends in a direction parallel to the axis that is coupled to the housing; and wherein the spring members further comprise a second straight portion coupled to another end of the curved portion that extends in a direction parallel to the axis that is not coupled to the housing.

* * * * *

UNITED STATES PATENT AND TRADEMARK OFFICE

CERTIFICATE OF CORRECTION

PATENT NO. : 7,921,908 B2
APPLICATION NO. : 12/233309
DATED : April 12, 2011
INVENTOR(S) : Steven K. Tetzlaff et al.

It is certified that error appears in the above-identified patent and that said Letters Patent is hereby corrected as shown below:

Column 3, line 39, insert --to-- before “accommodate”
Column 4, line 52, delete “and end” and insert --an end--
Column 5, line 8, insert --to-- before “convey”

Signed and Sealed this
Sixth Day of September, 2011

David J. Kappos

David J. Kappos
*Director of the United States Patent and Trademark Office*